United States Patent [19]

Paddock

[11] Patent Number: 4,584,439

[45] Date of Patent: Apr. 22, 1986

[54] AUDIO TRANSDUCER WITH CONTROLLED FLEXIBILITY DIAPHRAGM

[75] Inventor: Paul W. Paddock, McMinnville, Oreg.

[73] Assignee: Floating Membranes, Inc., Portland, Oreg.

[21] Appl. No.: 556,776

[22] Filed: Dec. 1, 1983

[51] Int. Cl.[4] ..... H04R 9/06

[52] U.S. Cl. ..... 179/115.5 PV; 179/117; 179/115.5 ME; 381/89

[58] Field of Search ..... 179/117, 115.5 R, 115.5 VC, 179/115.5 PV, 115.5 PS, 115.5 MG; 381/89; 181/163, 173

[56] References Cited

U.S. PATENT DOCUMENTS 3,699,249 10/1972 Crane ..... 179/115.5 PV

FOREIGN PATENT DOCUMENTS

| | | | |
|---|---|---|---|
| 1251381 | 10/1967 | France | 179/115.5 PV |
| 2759331 | 6/1971 | France | 179/115.5 PV |
| 2063662 | 7/1971 | France | 179/115.5 PV |
| 54-11881 | 9/1979 | Japan | 179/115.5 PV |
| WO80/01128 | 5/1980 | PCT Int'l Appl. | 179/115.5 PV |

*Primary Examiner*—Gene Z. Rubinson
*Assistant Examiner*—L. C. Schroeder
*Attorney, Agent, or Firm*—Kolisch, Hartwell & Dickinson

[57] ABSTRACT

An audio transducer for reproducing sound. The transducer may be utilized as a loudspeaker or a microphone. The transducer comprises a frame on which is mounted a pair of opposing permanent magnets, which produce opposing magnetic fields and a flexible diaphragm which encloses an elongate looped coil and passes through the magnetic field. A signal of variable amplitude in the coil accompanies movement of the diaphragm in what is described herein as rolling, linear movement.

8 Claims, 5 Drawing Figures

FIG. 1
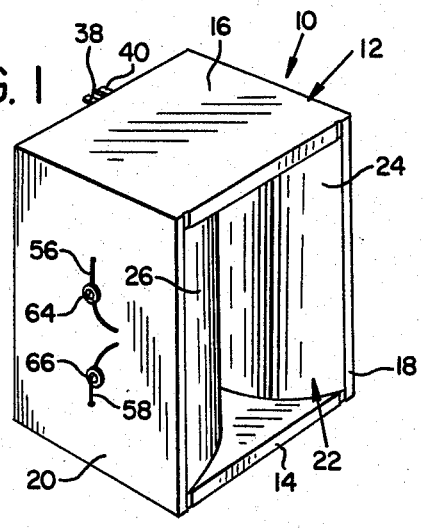
FIG. 3
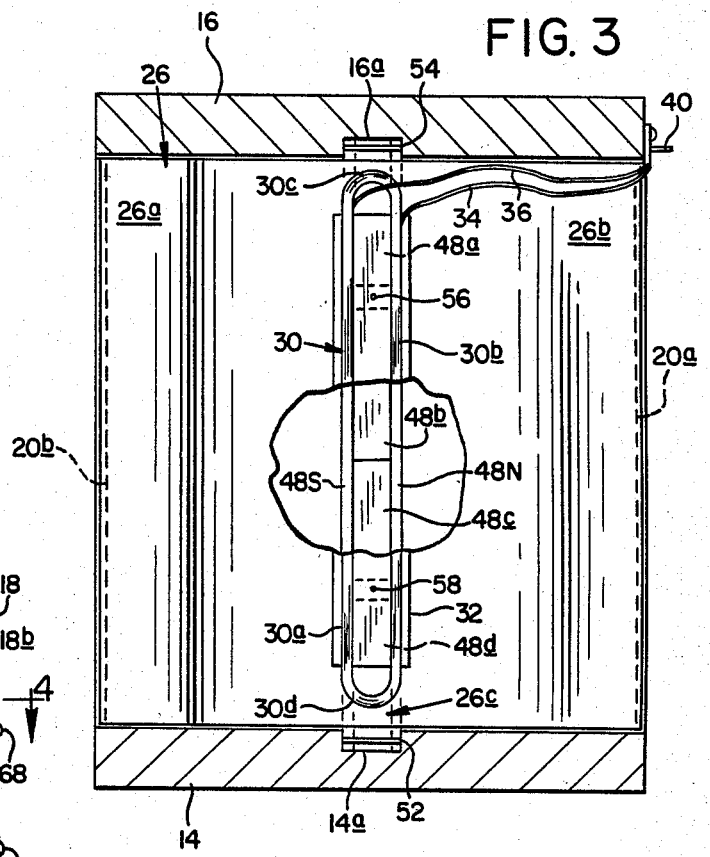
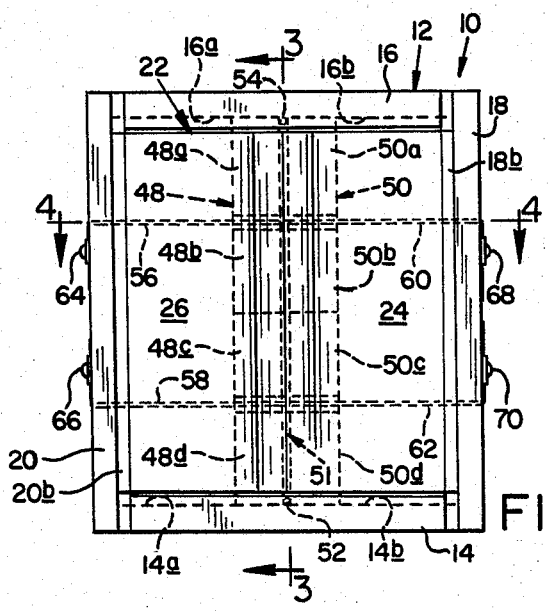
FIG. 2
FIG. 4
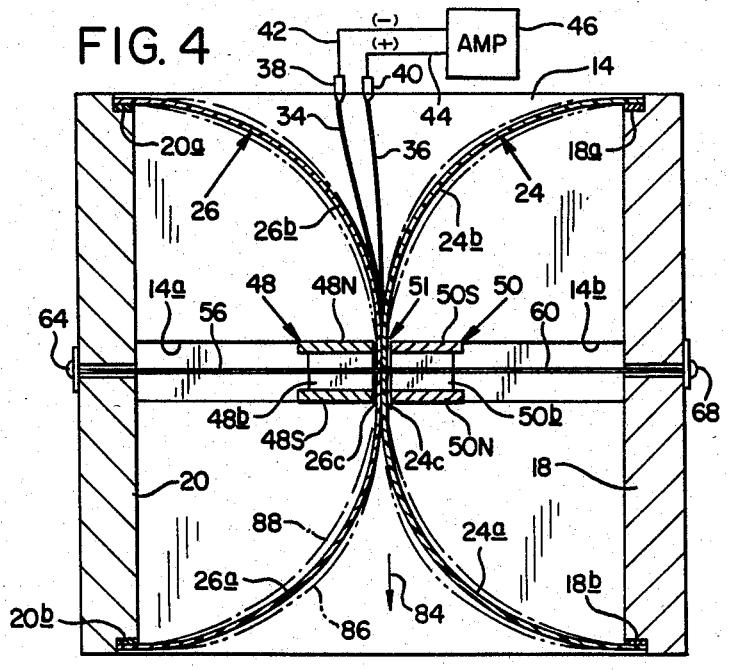
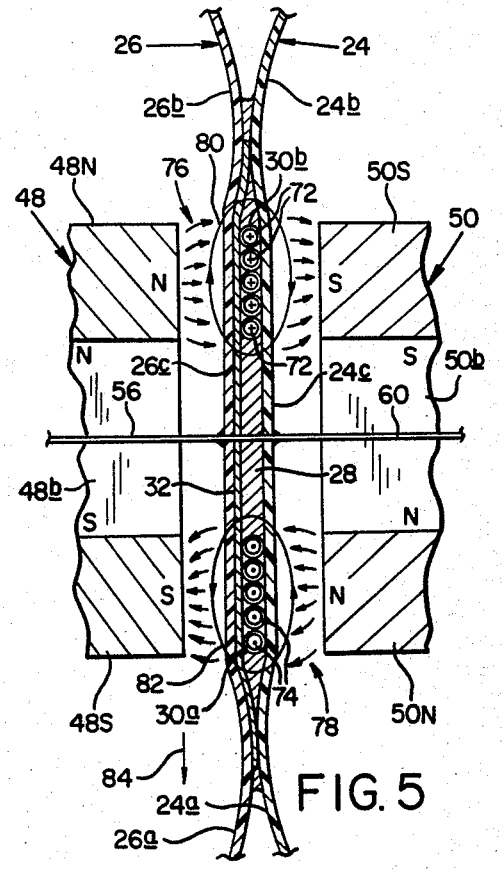
FIG. 5

AUDIO TRANSDUCER WITH CONTROLLED FLEXIBILITY DIAPHRAGM

BACKGROUND AND SUMMARY OF THE INVENTION

This is in relation to improvements in transducers, and more particularly to a transducer which has a diaphragm with an expanse extending generally in a plane and mounted in such a fashion that this expanse is movable in the direction of the plane. Coil means are attached to this expanse. Magnetic field means for producing a magnetic field adjacent to the coil means complete the transducer.

Various types of audio transducers, as exemplified by audio loudspeakers, are known in the prior art. One common form of transducer comprises a cone, with an electromagnetic motor driving element, mounted on a frame through a flexible expanse which bounds the perimeter of the cone. Generally speaking, such a transducer is characterized by relatively high diaphragm and coil mass which results in high inertial forces in the diaphragm and reduces its frequency response at high frequencies; or, the diaphragm and coil may be of relatively low mass and have reduced low frequency reproducing ability. Typically, the diaphragm is molded from a paper type of product which renders it susceptible to changes in relative humidiity. This alters frequency response and limits the life of the transducer.

Another type of loudspeaker known in the art comprises a horn type speaker having a flat diaphragm element which oscillates normal to the plane of the diaphragm element in response to activation by an electromagnetic driving element. The central diaphragm element is again mounted on a frame by means of an annular portion bounding the central expanse described. In some instances, such may be suspended and directly attached to a voice coil. With this type of speaker a rather large horn is required properly to direct and focus the sound waves produced. Again, by reason of the mass of the diaphragm and voice coil, the frequency response of the transducer tends to drop off at high frequencies. The transducers just described furthermore tend to be very expensive.

Audio transducers have characteristically become more complicated in design, the manufacturers relying on sealed cabinets, extremely heavy machine parts, and complicated voice coil arrangements in order to achieve the ultimate transducer.

Prior art speakers generally have exhibited a sudden drop in frequency response at the high end of the audio spectrum, typically above 20K hertz. This sudden decrease in frequency response has generally been attributed to high inertial coils and diaphragms, which are incapable of vibrating at extremely high frequencies.

Additionally, since an audio transducer which is responsive to low frequencies, in the vicinity of 20 to 250 hertz, is generally not responsive to frequencies above 15K hertz, several types or sizes of transducers are incorporated into a single cabinet, in order to provide adequate frequency response over the entire audio spectrum. The use of multiple transducers requires the incorporation of complex crossover networks to isolate audio signals traveling to or emanating from the individual transducers.

Generally, an object of this invention is to provide an improved transducer featuring a construction which overcomes difficulties and shortcomings of the type I have indicated.

More specifically, an object of the invention is to provide a transducer with a novel diaphragm construction wherein the diaphragm is of relatively low mass, the diaphragm also being ultimately flexible to provide essentially linear frequency response over the audio spectrum.

A feature of the transducer of the invention is a construction of the diaphragm which enables the manufacture of the diaphragm from material other than pressed material such as paper. As specifically comtemplated, the diaphragm may be manufactured, for instance, from a Mylar type of material. Such and similar material are moisture resistent and produce, over extended periods of time, a consistent predictable response to oscillation induced by an electromagnetic driving element.

The further object and feature of the invention is the provision of a transducer which may be simply manufactured without extreme criticality required in placement of parts and mountings, etc. Materials involved in construction of the transducer are readily available. All of the above tend to result in economies of manufacture.

Another feature and advantage of a transducer contemplated is derived from the flexibility of the diaphragm. This flexibility enables the diaphragm to expend its energy in making sound waves with minimal transmission of energy to the frame mounting the diaphragm and subsequent reduction in speaker efficiency.

A further object of the instant invention is to provide an audio transducer which exhibits a linearly decreasing frequency response at frequencies above 20K hertz by virtue of having a low inertia coil and diaphragm.

Another object of the instant invention is to provide an audio transducer which does not require a complex crossover network to accurately reproduce sound over the full audio spectrum.

The transducer of this instant application includes a generally rectangular open frame which carries opposing permanent magnets which generate what is referred to herein as opposing magnetic fields. A flexible diaphragm is secured to the frame and passes through the magnetic field. An elongate looped coil is carried on the diaphragm adjacent the opposed magnetic fields. A signal of variable amplitude in the coil accompanies movement of the diaphragm in what is described as rolling, linear movement.

These and other objects and advantages of the instant invention will become more fully apparent as the description which follows is read in conjunction with the accompanying drawings.

DESCRIPTION OF THE DRAWINGS

FIG. 1 is a perspective view of a transducer according to the instant invention.

FIG. 2 is an enlarged front elevation of the a transducer.

FIG. 3 is a further enlarged median section view, taken along line 3—3 in FIG. 2, showing the configuration of a coil in schematic form.

FIG. 4 is a further enlarged sectional view, taken along line 4—4 in FIG. 2.

FIG. 5 is a greatly enlarged view of portions of FIG. 4 where the coil of the transducer is located.

DETAILED DESCRIPTION OF A PREFERRED EMBODIMENT

Turning now to the drawings, and particularly to FIGS. 1 through 4, an audio transducer according to the present invention is shown generally at 10. The transducer of the preferred embodiment is intended for use as an audio loudspeaker, and the description of the transducer which follows will be addressed to use as a loudspeaker. It should be understood, however, that the transducer is also suitable for, and functions quite efficiently as, a microphone.

Transducer 10 includes an open rectangular frame, shown generally at 12. Frame 12 further includes a bottom member 14, a top member 16 and opposing side members 18, 20 which are rigidly attached to the top and bottom members. Frame 12 may be constructed of any suitable material of fairly high density and which has desirable acoustic properties, such as hardwood, or particle board. The frame may also be formed of injection molded plastic.

A diaphragm is shown generally at 22. Diaphragm 22 includes a pair of elongate resilient webs, 24,26. Each web includes flexible curved portions forming the ends of each web, joined to, and extending from, an intermediate, generally planar expanse. Thus, and considering web 24, such includes curved portions 24*a*, 24*b*, and a central expanse 24*c*. In the case of web 26 the curved portions are shown at 26*a*, 26*b* and the central expanse at 26*c*. The central expanses of the two webs are joined together, as with an adhesive, shown generally at 28 in FIG. 5, into a joined central expanse. The joined central expanse is supported on the frame by the flexible curved portions at the ends of the diaphragm. The joined central expanse, or diaphragm intermediate portion, may be thought of as an intermediate slack portion, with such being movable generally in the plane occupied by the expanse.

Side members 28 and 20 include isolation strips, 18*a*, 18*b*, and 20*a*, 20*b*, respectively, on their front and rear edges. Diaphragm webs 24, 26 are secured to frame 12 at the front and rear edges of sides 18 and 20, respectively, by attaching their end portions to the isolation strips. This arrangement provides that vibrations produced by the diaphragm are only minimally transmitted to the frame, enabling the diaphragm to expand most of its energy producing sound waves. The isolation strips may be made out of a suitable shock-absorbing porous or fibrous material, such as foam rubber or felt.

An electromagnetic coil, or coil means, shown generally at 30, is attached to the expanse of diaphragm 22 and is substantially enclosed by webs 24, 26 at their slack, intermediate portions 24*c*, 26*c*. Coil 30 is an elongate looped coil in the preferred embodiment, and contains what will be referred to herein (See FIG. 3) as an ascending portion 30*a*, a descending portion 30*b*, and an upper and lower transverse portions 30*c*, 30*d*, respectively. Coil 30, in the preferred embodiment is formed of 16 turns of 38 gauge copper wire. The wire is shaped on an adhesive backed tape 32 prior to being placed between webs 24, 26 and glued in place by adhesive 28. A pair of leads 34, 36 exit the diaphragm expanse and runs to frame side member 18 where it terminates in a pair of connectors, 38, 40, respectively. Audio transducer 10 is connected to a pair of amplifier leads 42, 44, which are in turn connected to an amplifier 46. Amplifier 46 generates alternating current impulses, which shift polarity between 20 and 20,000 times per second. The combination of leads 34, 36, connectors 38, 40 and amplifier leads 42, 44, constitute means connecting amplifier 46 to transducer 10. Amplifier 46 and transducer 10 comprise what is referred to herein as an audio assembly. The means connecting, or connecting means, conduct electrical impulses between amplifier 46 and transducer 10.

Two sets of opposed magnets 48, 50, are attached to the frame and held in place in magnet retaining grooves 14*a*, 14*b*, 16*a*, 16*b* which are cut in bottom and top members 14 and 16, respectively. Magnets 48, 50 may be of the metal bar-magnet type, or, as in the preferred embodiment, high quality (strontium ferrite) ceramic magnets, 48*a*, 48*b*, 48*c*, 48*d*, 50*a*, 50*b*, 50*c*, 50*d*, standard in the audio industry, fastened together with adhesive. The magnets must be polarized across their major faces, as indicated in FIG. 5, for the transducer to properly function. A pair of magnetically permeable plates 48N and 48S, 50N and 50S made of low carbon (0.003%) steel are attached to the major faces of magnets 48, 50, respectively. An opposing magnetic field is established in that plates 48N and 50N are polarized to a north magnetic pole and plates 48S and 50S are polarized to a south magnetic pole. The plates thus produce what is referred to herein as an opposing magnetic field, whose lines of flux are normal to the expanse of diaphragm 22 across a gap 51.

Magnets 48 and 50 are separated by a pair of non-ferrous spacers, 52, 54. The spacers in the preferred embodiment are copper rods which prevent magnets 48 and 50 from closing gap 51. The diaphragm central expanse is additionally supported and centered by string-like supports 56, 58, 60, 62 which are secured to and extend from the diaphragm central expanse through the frame side members to tensioning fasteners 64, 66, 68, 70, respectively. The supports in the preferred embodiment are made of a woven, non-stretch nylon thread.

Turning now to FIGS. 2 through 4, the workings of transducer 10 will be further explained. An electrical impulse arriving at connectors 38, 40 is transmitted to coil 30. Since coil 30 is a continuous loop, a flow of current is established in the coil, thereby producing a magnetic field about the coil. Current flow is represented in coil 30 by flow indicators at 72 and 74 in FIG. 5. Lines of magnetic flux between plates 48N and 50S are indicated by the arrows at 76; the magnetic flux between plates 50N and 48S are indicated by the arrows at 78.

The location of the plates on either side of magnets 48, 50, result in a uniform external magnetic field about coil 30. As current passes through coil 30, resultant lines of magnetic induction are established, which essentially form a clockwise field 80 around descending loop 30*b* and a counterclockwise field 82 around ascending loop 30*a*.

The motion of a charged wire within a magentic field is determined by the direction of current in the wire relative to the lines of magnetic flux. At any point where the two fields meet, the resultant magnetic induction will be the vector sum of the external field and the magnetic induction field associated with the current in the wire.

In the situation depicted, amplifier 46 has a "positive" lead connected to connection 38 and a "negative" lead connected to connection 40. This results in a current flow as depicted at 72 and 74. Under the influence of current produced by amplifier 46, coil 30 will tend to move in the direction indicated by arrow 84. When the amplifier alternates current flow, current flow in coil 30 reverses, moving the coil and the diaphragm in a direction opposite that of arrow 84.

It should be obvious to those skilled in the art that were coil 30 surrounded by a single, non-opposing magnetic field, the result of a current passing through coil 30 would be a torsional movement of the coil about its major axis, rather than a linear movement of the coil as is produced by the arrangement of the instant invention.

Amplifier 46 produces a current of varying intensity, thereby producing a resultant induced field about coil 30 of varying intensity. The result is an oscillation of coil 30, and a resultant oscillation of diaphragm 22 of varying travel distance relative the permanent opposing magnetic fields, 76, 78, established by magnets 48 and 50. A decrease in current intensity within coil 30 results in a collapse of the induced magnetic field and produces a resultant movement in coil 30 and diaphragm 22 in a direction opposite that shown by arrow 84.

Thus, as shown by the phantom lines in FIG. 4, diaphragm 22 is free to deform along its flexible curved portions in response to movement induced by coil 30. Movement of the diaphragm in the direction of arrow 84 results in diaphragm 22 assuming the shape illustrated by the dash-double-dot line 86, while movement of the diaphragm opposite that of arrow 84 results in the configuration shown by dash-dot line 88. Movement of the diaphragm between these two representative positions is accomplished through what may be described as a linear rolling-type action in that the flexible curved portions deform to some extent, while the movable intermediate expanse remains substantially unflexed and continues to move within a plane defined by the central expanse of the diaphragm.

Thus a new form of audio transducer has been disclosed. The transducer of the instant invention, when configured for use as a loudspeaker, has been found, in the preferred embodiment, to have a nominal impedance of eleven ohms. The transducer has been tested with a frequency response analyzer and has been found to have an essentially flat response from 100 to 20K+ hertz when driven by standard test equipment. Additionally, the transducer has been found to perform satisfactorily with a minimum input of 15 watts, and is capable of handling an input of at least 300 watts.

In the preferred embodiment, diaphragm webs 24, 26 are formed of 5 mil Mylar. This substance flexes predictably and has a relatively low mass per unit volume. Because both the coil and the diaphragm are relatively low mass structures, they do not produce high inertial forces when oscillated by an impulse from the amplifier. This use of light weight material results in an essentially flat frequency response which decreases linearly at its upper end.

An additional benefit which is gained by using Mylar for the diaphragm and nylon string for the diaphragm supports is a transducer which is not subject to variations in response as a result of changes in humidity.

A plurality of transducers may be incorporated into a single cabinet. Since the transducer, when used as a loudspeaker, radiates sound waves bi-directionally, it may be desirable to include some baffling in a speaker cabinet to prevent "dead-spots," which may result from sound wave cancellation at certain points in the listening room. When the transducer is used as a microphone, however, it is bi-directionally sensitive, producing a microphone with a figure eight sensitivity pattern.

The transducer may be constructed with diaphragm webs of varying thicknesses and coils of varying electrical characteristics in order to produce a transducer which will respond within predetermined frequency ranges. Several transducers with differing sound-reproducing characteristics may be incorporated into a single loudspeaker cabinet and connected by means of a simple crossover network to respond to electrical impulses representing a particular frequency range.

The overall construction of the transducer enables production of the units without the need for complex, highly accurate placement of component parts. Component parts are readily available, and, with simple construction techniques, enable production with minimal financial expenditure.

When the transducer is constructed for use as a microphone, the diaphragm webs are formed of 1 mil Mylar and the coil is formed of 50 gauge or finer wire.

While a preferred embodiment of the invention has been described, it is appreciated that variations and modifications may be made without departing from the spirit of the invention.

It is claimed and desired to secure by Letters Patent:

1. An audio transducer and amplifier assembly which comprises a frame, a diaphragm comprising a pair of elongate resilient webs having intermediate portions disposed with one beside the other and joined to each other which form a movable expanse in the diaphragm and said expanse extending substantially in a plane, said expanse being movable in the direction of said plane, said webs in said diaphragm having flexible curved end portions extending from said expanse which are secured at locations remote from said expanse to said frame, coil means attached to said expanse of the diaphragm, opposing magnetic field means for producing opposing magnetic fields, extending normal said expanse, and an audio amplifier and means connecting said coil means to said amplifier for conducting electrical impulses between said coil means and said amplifier.

2. The assembly of claim 1, wherein said diaphragm comprises a pair of elongate resilient webs having intermediate portions disposed with one beside the other which are said expanse, said webs further having end portions which are said flexible curved portions.

3. The assembly of claim 1, which further includes at least one pair of string-like supports which support and center said expanse.

4. An audio transducer and amplifier assembly which comprises a frame, a diaphragm, comprising a pair of elongate resilient webs, each of said webs having a web expanse intermediate its end and said web expanses of said webs being joined together to form a slack portion in said diaphragm, said slack portion extending substantially in a plane and being movable in a direction extending generally in said plane, said webs having ends and said ends being attached to said frame, looped coil means extending substantially in said plane attached to said slack portion, magnetic field means for producing a magnetic field adjacent said coil means, such that a signal of variable amplitude in said coil means accompanies movement of said slack portion in the direction of said plane.

5. The assembly of claim 4, wherein said said coil means is substantially enclosed between the web expanses of said webs.

6. The assembly of claim 4, wherein one of said webs has first and second web sections joined to opposite extremities of the web expanse of the one web curving laterally to one side of said plane, and the other of said webs has second and third web sections joined to opposite extremities of the web expanse of said other web curving laterally to the other side of said plane, the ends of said one web terminating said first and second web sections and the ends of said other web terminating said second and third web section.

7. The assembly of claim 4, which further includes at least one pair of string-like supports which support and center said slack portion.

8. An audio transducer and amplifier assembly which comprises a frame, a pair of opposed oppositely positioned and spaced apart magent pieces producing a magnetic field extending across the space between the magnet pieces, a diaphragm having a movable central expanse extending within said space and in a direction generally normal to said field and having opposite extremities located adjacent opposite sides of said field, said diaphragm further including a flexible curved portion joining with said expanse at one of its extremities and extending away from said expanse in one direction to a connection with said frame and another flexible curved portion joining with said expanse at the other of its extremities and extending away from said expanse in a direction opposite to said one direction to a connection with said frame, coil means attached to said expanse of the diaphragm, and an audio amplifier and means connecting the coil means to said amplifier for conducting electrical impulses between the coil means and amplifier.

* * * * *